US007100690B2

(12) United States Patent
Mullen et al.

(10) Patent No.: US 7,100,690 B2
(45) **Date of Patent: *Sep. 5, 2006**

(54) GRAVEL PACKING APPARATUS HAVING AN INTEGRATED SENSOR AND METHOD FOR USE OF SAME

(75) Inventors: Bryon David Mullen, Carrollton, TX (US); Henry Louis Restarick, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 110 days.
This patent is subject to a terminal disclaimer.

(21) Appl. No.: 10/763,298
(22) Filed: Jan. 22, 2004

(65) Prior Publication Data

US 2004/0173352 A1 Sep. 9, 2004

Related U.S. Application Data

(63) Continuation-in-part of application No. 10/323,102, filed on Dec. 18, 2002, now Pat. No. 6,684,951, which is a continuation of application No. 09/615,016, filed on Jul. 13, 2000, now Pat. No. 6,554,064.

(51) Int. Cl.
*E21B 43/04* (2006.01)
*E21B 47/09* (2006.01)

(52) U.S. Cl. ..... 166/278; 166/51; 166/236; 166/253.1

(58) Field of Classification Search ..... 166/250.01, 166/276, 278, 66.4, 66.6, 66.7, 227, 228, 166/230, 51, 369, 250.17, 250.07, 255.1, 166/241.4, 236, 241.6, 235, 253.1, 234
See application file for complete search history.

(56) References Cited

U.S. PATENT DOCUMENTS 1,972,162 A 10/1934 Layne
2,342,913 A 2/1944 Williams et al.

(Continued)

FOREIGN PATENT DOCUMENTS

DE 35 03 239 A1 8/1996

(Continued)

OTHER PUBLICATIONS

"Baker PZM2000TM Sand Control System"; Pay Zone Production Monitoring System; Baker Oil Tools; Baker Hughes; 14 pages.

(Continued)

*Primary Examiner*—Jennifer H. Gay
(74) *Attorney, Agent, or Firm*—Lawrence R. Youst

(57) ABSTRACT

A gravel packing apparatus (310) has an outer tubular (312) having a plurality of openings (314) therethrough and a sand control screen assembly (318) disposed within the outer tubular (312). The sand control screen assembly (318) prevents the flow of particulate material of a predetermined size therethrough but allows the flow of production fluids therethrough. Sensors (354–360) are operably coupled to the outer tubular (312), the sand control screen assembly (318) or both. An instrument line (348) disposed between the outer tubular (312) and the sand control screen assembly (318) is operably associated with the sensors (354–360) such that power, signals and data may be transmitted between the sensors (354–360) and the surface or other downhole systems.

56 Claims, 9 Drawing Sheets

U.S. PATENT DOCUMENTS 2,344,909 A 3/1944 Williams et al.
3,688,188 A 8/1972 Bak et al.
4,102,395 A 7/1978 Robinson
4,428,428 A 1/1984 Smyrl et al.
4,558,742 A 12/1985 Huang et al.
4,627,488 A 12/1986 Szarka
4,890,682 A 1/1990 Worrall et al.
4,932,474 A 6/1990 Schroeder, Jr. et al.
4,945,991 A 8/1990 Jones
4,972,906 A 11/1990 McDaniel
5,082,052 A 1/1992 Jones et al.
5,113,935 A 5/1992 Jones et al.
5,161,613 A 11/1992 Jones
5,161,618 A 11/1992 Jones et al.
5,165,476 A 11/1992 Jones
5,247,156 A * 9/1993 Favre ..... 219/209
5,252,832 A * 10/1993 Nguyen et al. ..... 250/390.01
5,309,405 A 5/1994 Brett et al.
5,333,688 A 8/1994 Jones et al.
5,339,895 A 8/1994 Arterbury et al.
5,343,949 A 9/1994 Ross et al.
5,355,956 A 10/1994 Restarick
5,390,966 A 2/1995 Cox et al.
5,419,394 A 5/1995 Jones
5,443,117 A 8/1995 Ross
5,476,143 A 12/1995 Sparlin et al.
5,477,506 A 12/1995 Allen
5,481,105 A 1/1996 Gold
5,515,915 A 5/1996 Jones et al.
5,577,559 A 11/1996 Voll et al.
5,579,842 A 12/1996 Riley
5,588,487 A 12/1996 Bryant
5,636,691 A 6/1997 Hendrickson et al.
5,664,628 A * 9/1997 Koehler et al. ..... 166/369
5,730,223 A 3/1998 Restarick
5,755,286 A 5/1998 Ebinger
5,803,170 A 9/1998 Garcia-Soule et al.
5,829,520 A 11/1998 Johnson
5,833,490 A 11/1998 Bouldin
5,842,516 A 12/1998 Jones
5,848,645 A 12/1998 Jones
5,865,251 A 2/1999 Rebardi et al.
5,868,200 A 2/1999 Bryant et al.
5,890,533 A 4/1999 Jones
5,901,789 A * 5/1999 Donnelly et al. ..... 166/381
5,921,318 A 7/1999 Ross
5,933,945 A * 8/1999 Thomeer et al. ..... 29/825
5,934,376 A 8/1999 Nguyen et al.
5,963,317 A 10/1999 Hamid et al.
5,964,296 A 10/1999 Ross
5,988,285 A 11/1999 Tucker et al.
6,003,600 A 12/1999 Nguyen et al.
6,047,773 A 4/2000 Zeltmann et al.
6,056,327 A 5/2000 Bouldin et al.
6,059,032 A 5/2000 Jones
6,065,535 A 5/2000 Ross
6,116,343 A 9/2000 Van Petegem et al.
6,125,933 A 10/2000 Ross
6,220,345 B1 4/2001 Jones et al.
6,227,303 B1 5/2001 Jones
6,230,803 B1 5/2001 Morton et al.
6,302,208 B1 10/2001 Walker et al.
6,343,651 B1 2/2002 Bixenman
6,450,263 B1 9/2002 Schwendemann
6,464,007 B1 10/2002 Jones
6,516,881 B1 2/2003 Hailey, Jr.
6,516,882 B1 2/2003 McGregor et al.
6,554,064 B1 4/2003 Restarick et al.
6,557,634 B1 5/2003 Hailey, Jr. et al.
6,581,689 B1 6/2003 Hailey, Jr.
6,588,506 B1 7/2003 Jones
6,588,507 B1 7/2003 Dusterhoft et al.
6,601,646 B1 * 8/2003 Streich et al. ..... 166/278
6,607,032 B1 * 8/2003 Voll et al. ..... 166/227
6,681,854 B1 1/2004 Danos
6,684,951 B1 2/2004 Restarick et al.
6,805,202 B1 10/2004 Gillespie et al.
6,817,410 B1 11/2004 Wetzel et al.
6,830,104 B1 * 12/2004 Nguyen et al. ..... 166/278
2002/0007948 A1 1/2002 Bayne et al.
2002/0088744 A1 * 7/2002 Echols et al. ..... 210/170
2002/0092649 A1 7/2002 Bixenman et al.
2002/0125008 A1 * 9/2002 Wetzel et al. ..... 166/278
2002/0157837 A1 10/2002 Bode et al.
2003/0085038 A1 * 5/2003 Restarick et al. ..... 166/278
2004/0016539 A1 1/2004 Richard
2005/0072564 A1 * 4/2005 Grigsby et al. ..... 166/65.1
2005/0074196 A1 * 4/2005 Grigsby et al. ..... 385/12

FOREIGN PATENT DOCUMENTS

EP 1 132 571 A1 2/2001
GB 2 353 148 A 2/2001
GB 2 382 606 A 6/2003
WO WO 99/12630 3/1999
WO WO 00/61913 10/2000
WO WO 01/14691 A1 3/2001
WO WO 01/42620 A1 6/2001
WO WO 01/44619 A1 6/2001
WO WO 01/49970 A1 7/2001
WO WO 02/10554 A1 2/2002
WO WO 2004/011773 A1 2/2004

OTHER PUBLICATIONS

Corbett et al.; "Fiber Optic Monitoring in Openhole Gravel Pack Completions"; SPE 77682; Society of Petroleum Engineers Inc.; SPE Annual Technical Conference and Exhibition; Sep. 29-Oct. 2, 2002; pp. 1-14.
Restarick of Otis Engineering Corp.; "Mechanical Fluid-Loss Control Systems Used During Sand Control Operations"; 1992; pp. 21-36.
Halliburton Energy Services, Inc.; "Sand Control Screens"; 1994; 4 pages.
Ebinger of Ely & Associates Inc.; "Frac Pack Technology Still Evolving"; 1995; pp. 60-70; Oil & Gas Journal.
Hailey and Cox of Halliburton Energy Services, Inc. and Johnson of BP Exploration (Alaska); "Screenless Single Trip Multizone Sand Control Tool System Saves Rig Time"; Feb. 2000; pp. 1-11; Society of Petroleum Engineers Inc.
Hallibruton Energy Services, Inc.; "Caps Sand Control Service for Horizontal Completions Improves Gravel Pack Reliability and Increases Production Potential from Horizontal Completions"; Aug. 2000; 2 pages.
Halliburton Energy Services, Inc.; "CAPS Concertric Annular Packing Service for Sand Control"; Aug. 2000; 4 pages.
Saldungaray of Schlumberger, Troncoso and Santoso of Repsol-YPF; "Simultaneous Gravel Packing and Filter Cake Removal in Horizontal Wells Applying Shunt Tubes and Novel Carrier and Breaker Fluid"; Mar. 2001; pp. 1-6; Society of Petroleum Engineers, Inc.
Schlumberger: "QUANTUM Zonal Isolation Tool"; pp. 12-13; Sand Face Completions Catalog.
Halliburton Energy Services, Inc.; "Absolute Isolation System (AIS) Components"; 1 page.
OSCA Corporate Headquarters; "HPR-ISO System"; 2000; 1 page; Technical Bulletin.
OSCA Corporate Headquarters; "The ISO System"; 2000; 1 page; Technical Bulletin.
PES Inc.; "Umbilical"; undated; p. 10.
Schlumberger Dowell; "Alternate Path Services—Maximum gravel placement for STIMPAC service and gravel packs"; undated; 1 page.
Halliburton Energy Services, Inc.; "SurePac Multiple Path Screen System Your Premium Horizontal Gravel Pack Solution"; 2002; 1 page.

* cited by examiner

GRAVEL PACKING APPARATUS HAVING AN INTEGRATED SENSOR AND METHOD FOR USE OF SAME

CROSS-REFERENCE TO RELATED PATENT APPLICATIONS

This application is a continuation-in-part application of Ser. No. 10/323,102 filed Dec. 18, 2002, now U.S. Pat. No. 6,684,951, which is a continuation of Ser. No. 09/615,016 filed Jul. 13, 2000, now U.S. Pat. No. 6,554,064.

TECHNICAL FIELD OF THE INVENTION

This invention relates in general to preventing the production of particulate materials through a wellbore traversing an unconsolidated or loosely consolidated subterranean formation and, in particular, to a gravel packing apparatus having an integrated sensor and a method for use of the same.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as the tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Therefore, a need has arisen for an apparatus and method for gravel packing a production interval traversed by a wellbore that is capable of monitoring the gravel packing operation. More specifically, a need has arisen for such an apparatus that is capable of providing real time data on the effectiveness of the gravel placement operation. In addition, a need has arisen for such an apparatus that is capable of discovering voids during the placement of the gravel thereby allowing the operator to correct this undesirable situation.

SUMMARY OF THE INVENTION

The present invention disclosed herein comprises a gravel packing apparatus and method for gravel packing a production interval of a wellbore that traverses an unconsolidated or loosely consolidated formation. The gravel packing apparatus of the present invention uses sensors that provide real time data on the effectiveness of the gravel placement operation such as discovering voids during the placement of the gravel so that the operator may adjust treatment parameters such as pump rate, proppant concentration, fluid viscosity and the like. Additionally, once production has commenced from the well, the sensors provide information relating to the production process including fluid velocity through the screen, the constituent content of oil, water and gas, fluid temperature, fluid pressure and the like which allow the operator to enhance the operation of the production from the well.

In one aspect, the present invention is directed to a gravel packing apparatus that includes an outer tubular having a plurality of openings therethrough and a sand control screen assembly disposed therein. The sand control screen assembly prevents the flow of particulate material of a predetermined size therethrough but allows the flow of production fluids therethrough. One or more sensors are operably coupled to the outer tubular, the sand control screen assembly or both. One or more instrument lines are disposed between the outer tubular and the sand control screen assembly. At least one instrument line is operably associated with each of the sensors.

In one embodiment, the gravel packing apparatus includes one or more slurry passageways disposed between the outer tubular and the sand control screen assembly and one or more production pathways also disposed between the outer tubular and the sand control screen assembly. In this embodiment, the instrument lines may be disposed within one of the slurry passageways, within one or more of the production pathways or both. In another embodiment, the instrument line may be part of an umbilical line that includes a hydraulic line and a pair of bumper bars.

In one embodiment, the sensors may be powered by a downhole power source. In another embodiment, the sensors may be powered by a surface power source. The sensors may be any type of sensors that provide valuable information from a downhole environment such as pressure sensors, temperature sensors, density meters, accelerometers and the like. In addition, the sensors may be coupled to one or more components such as a memory, a microprocessor, a transceiver, an actuator or the like.

In another aspect, the present invention is directed to a gravel packing apparatus that includes first and second joints each having substantially the same construction and each having a perforated outer tubular, a sand control screen assembly disposed within the outer tubular, a sensor operably coupled to one of the outer tubular and the sand control screen assembly and an instrument line disposed between the outer tubular and the sand control screen assembly. The instrument line has ends that extend exteriorly of the outer tubular and the instrument line is operably associated with the sensor. After the first and second joints are coupled together, an instrument line connector is used to connect respective ends of the instrument line from the first and second joints together.

In yet another aspect, the present invention is directed to a gravel packing apparatus that includes first and second joints each having substantially the same construction and each having a sand control screen assembly with a perforated base pipe and a filter medium, a sensor operably coupled to one of the base pipe and a filter medium and an instrument line disposed between the base pipe and a filter medium. The instrument line has ends that extend exteriorly of the base pipe and the filter medium and the instrument line is operably associated with the sensor. After the first and second joints are coupled together, an instrument line connector is used to connect respective ends of the instrument line from the first and second joints together.

In a further aspect, the present invention is directed to a method for treating an interval of a wellbore that involves locating a gravel packing apparatus having an outer tubular positioned around a sand control screen assembly within the interval of the wellbore forming a wellbore annulus, injecting a treatment fluid into the wellbore annulus and monitoring the treatment process with a sensor operably coupled to one of the outer tubular and the sand control screen assembly.

In an additional aspect, the present invention is directed to a method for treating an interval of a wellbore that involves coupling first and second joints of a gravel packing apparatus together, each joint have a sensor operably associated therewith and an instrument line disposed therein having ends that extend outwardly therefrom, connecting the ends of the instrument lines from respective joints of the gravel packing apparatus, locating the first and second joints within the interval of the wellbore forming a wellbore annulus, injecting a treatment fluid into the wellbore annulus and monitoring the treatment process with the sensors.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
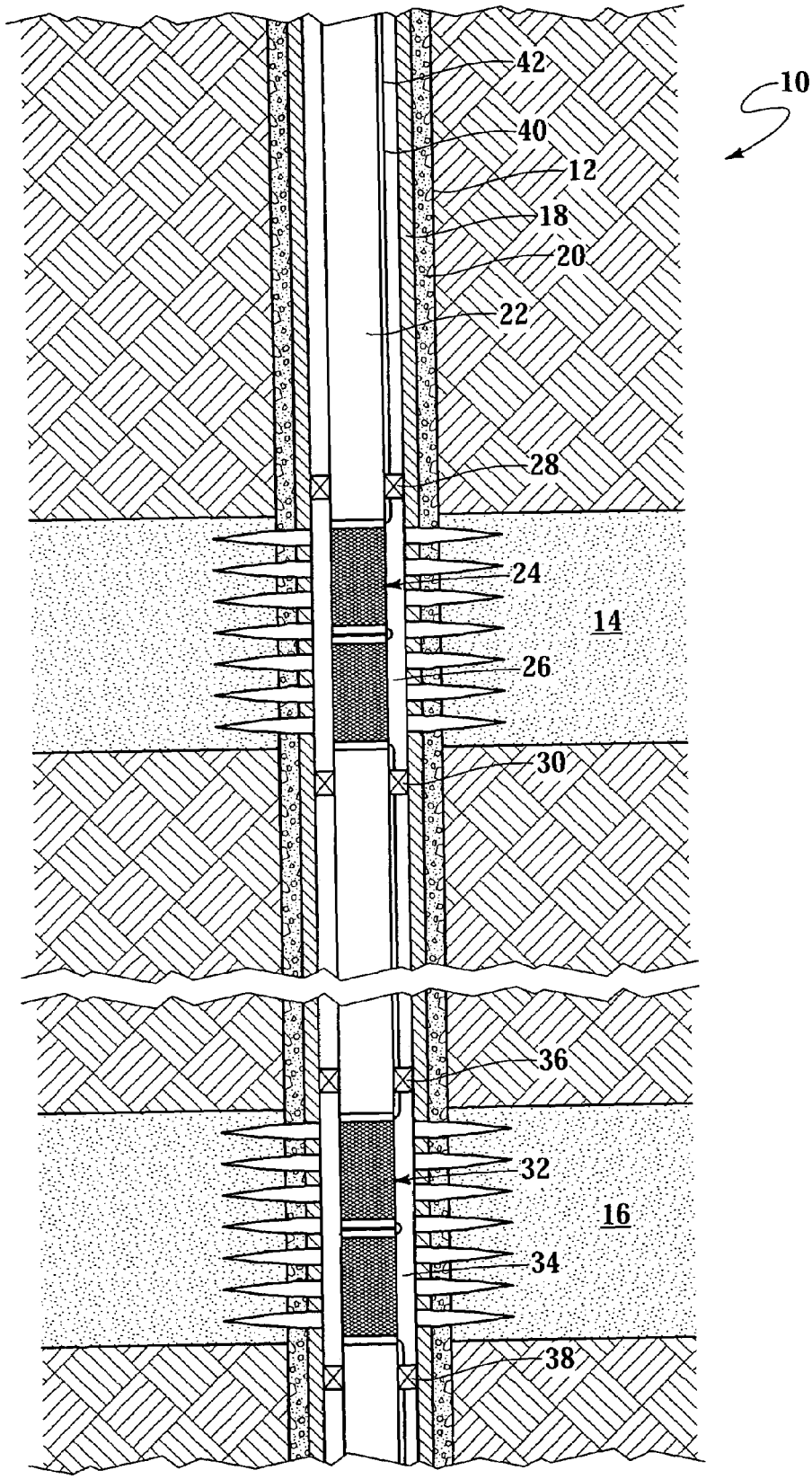
FIG. 1 is a schematic illustration of a subterranean region including a pair of formations traversed by a wellbore having positioned therein a plurality of gravel packing apparatuses having integrated sensors of the present invention.

Referring initially to FIG. 1, a pair of gravel packing apparatuses having integrated sensors used during the treatment of multiple intervals of a wellbore is schematically illustrated and generally designated 10. A wellbore 12 extends through the various earth strata including formations 14, 16. A casing 18 is cemented within wellbore 12 by cement 20. A work string 22 includes various tools such as a gravel packing apparatus 24 which is positioned within a perforated production interval 26 between packers 28, 30 and adjacent to formation 14. In addition, work string 22 includes a gravel packing apparatus 32 which is positioned within a perforated production interval 34 between packers 36, 38 and adjacent to formation 16. One or more control lines 40 extend from the surface within annulus 42 as pass through gravel packing apparatuses 24, 32 to provide instructions, carry power, signals and data, and transport operating fluid, such as hydraulic fluid, to sensors, actuators and the like associated with gravel packing apparatuses 24, 32 or otherwise positioned downhole.

Once work string 22 is positioned as shown within wellbore 12, a treatment fluid containing sand, gravel, proppants or the like is pumped down work string 22 such that formations 14, 16 and perforated production intervals 26, 34 may be treated. Sensors operably associated with gravel packing apparatuses 24, 32 are used to provide substantially real time data on the effectiveness of the treatment operation. For example, during a gravel packing operation, voids may be identified during the gravel placement process that allow the operator to adjust treatment parameters such as pump rate, proppant concentration, fluid viscosity and the like to overcome deficiencies in the gravel pack. In addition, these sensors continue to provide valuable information during the production phase of the well such as fluid temperature, pressure, velocity, constituent composition and the like such that the operator can enhance the operation of the production from the well.

Even though FIG. 1 depicts a vertical well, it should be noted by one skilled in the art that the gravel packing apparatuses having integrated sensors of the present invention are equally well-suited for use in wells having other directional orientations such as deviated wells, inclined wells or horizontal wells. Also, even though FIG. 1 depicts each gravel packing apparatus as consisting of two sections, it should be noted by one skilled in the art that the gravel packing apparatuses of the present invention may comprise any number of sections joined directly or indirectly together, the number of sections depending upon the length of the production interval and other parameters that are well known in the art. Also, even though FIG. 1 depicts two formations, it should be understood by one skilled in the art that the treatment processes and the gravel packing apparatuses of the present invention are equally well-suited for use in wells having any number of formations.

Figure 2:
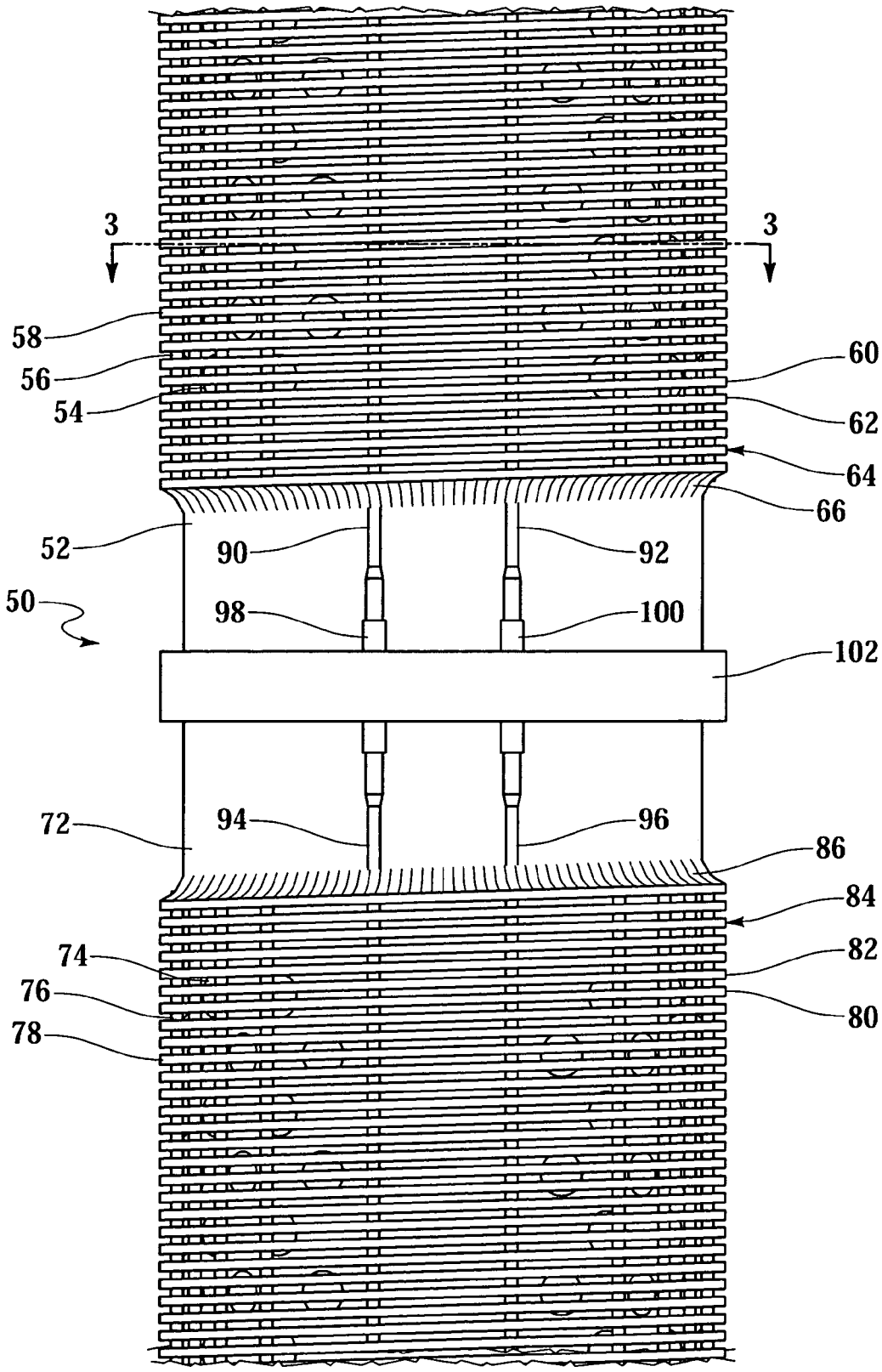
FIG. 2 is a side view of a gravel packing apparatus having integrated sensors of the present invention.

Referring now to FIG. 2, therein is depicted a more detailed illustration of two adjacent sections of a gravel packing apparatus having integrated sensors of the present invention that is generally designated 50. In the illustrated embodiment, gravel packing apparatus 50 includes an upper base pipe 52 that has a plurality of openings 54 which allow the flow of fluids therethrough. The exact number, size and shape of openings 54 are not critical to the present invention, so long as sufficient area is provided for fluid production and the integrity of base pipe 52 is maintained.

Spaced around base pipe 52 is a plurality of ribs 56. Ribs 56 are generally symmetrically distributed about the axis of base pipe 52. Ribs 56 are depicted as having a cylindrical cross section, however, it should be understood by one skilled in the art that ribs 56 may alternatively have a rectangular or triangular cross section or other suitable geometry. Additionally, it should be understood by one skilled in the art that the exact number of ribs 56 and the amount of stand off provided by ribs 56 are design characteristics that are well known in the art. Wrapped around ribs 56 is a screen wire 58. Screen wire 58 forms a plurality of turns, such as turn 60 and turn 62. Between each of the turns is a gap through which fluids flow. The number of turns and the gap between the turns are determined based upon the characteristics of the formation from which fluid is being produced and the size of the particulate material to be used during the treatment operation. Together, ribs 56 and screen wire 58 form a sand control screen jacket 64 which is attached to base pipe 52 at weld 66 or by other suitable technique.

Similarly, gravel packing apparatus 50 includes a lower base pipe 72 that has a plurality of openings 74 which allow the flow of fluids therethrough. Spaced around base pipe 72 is a plurality of ribs 76. Wrapped around ribs 76 is a screen wire 78 that forms a plurality of turns, such as turn 80 and turn 82. Between each of the turns is a gap through which fluids flow. Together, ribs 76 and screen wire 78 form a sand control screen jacket 84 which is attached to base pipe 72 at weld 86 or by other suitable technique.

Base pipes 52, 72 are attached directly together via a box and pin type threaded coupling. Preferably, the threads of base pipes 52, 72 are timed such that a desired circumferential orientation between base pipes 52, 72 can be achieved. Alternatively, base pipes 52, 72 may utilize a ratch latch connection, collar connection or other suitable connection to circumferential align base pipes 52, 72.

Figure 3:
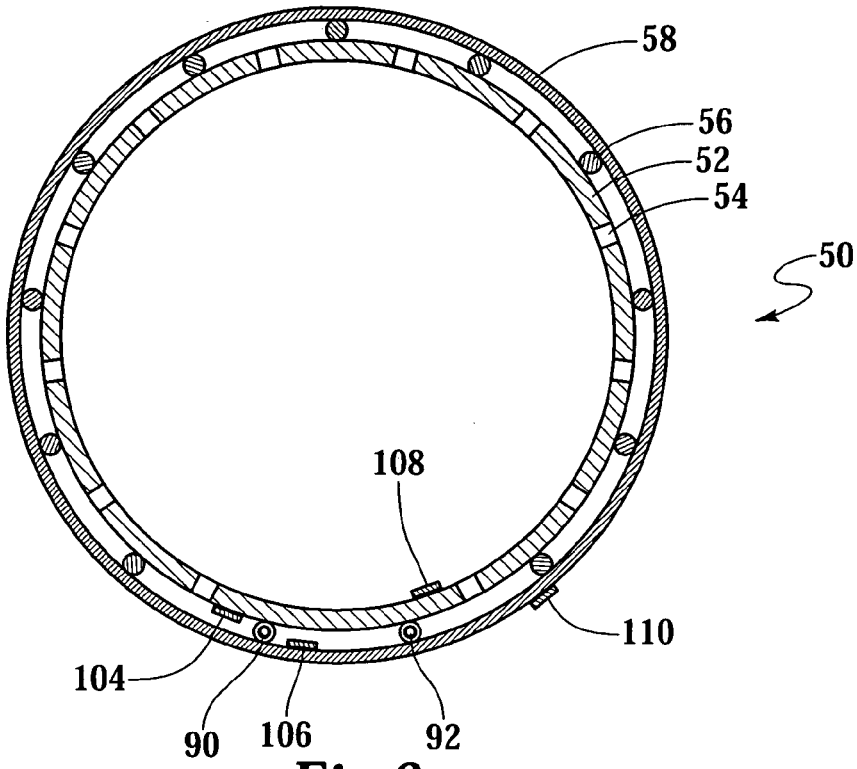
FIG. 3 is a cross sectional view taken along line 3—3 of FIG. 2 of a gravel packing apparatus having integrated sensors of the present invention.

In the illustrated embodiment, two control lines pass through gravel packing apparatus 50. Specifically, an instrument line 90, such as a copper wire, a coaxial cable, a fiber optic bundle, a twisted pair or other line suitable for transmitting power, signals, data and the like, and a hydraulic line 92 are positioned between base pipe 52 and screen wire 58 and pass through weld 66. Preferably, instrument line 90 and hydraulic line 92 replace two of the ribs 56 and are located adjacent to portions of base pipe 52 without openings 54, as best seen in FIG. 3. Likewise, an instrument line 94 and a hydraulic line 96 are positioned between base pipe 72 and screen wire 78, pass through weld 86, replace two of the ribs 76 and are located adjacent to portions of base pipe 72 without openings 74.

When base pipes 52, 72 are coupled together, instrument line 90 and hydraulic line 92 are substantially circumferentially aligned with instrument line 94 and hydraulic line 96 to allow for the coupling of instrument line 90 with instrument line 94 via high pressure instrument wire connector 98, as explained in greater detail below and hydraulic line 92 with hydraulic line 96 via high pressure hydraulic line connector 100, also as explained in greater detail below. Once the connections are made between instrument lines 90, 94 and hydraulic lines 92, 96, a support 102 such as a band, a collar, a block or other suitable device is used to maintain connectors 98, 100 in position adjacent to base pipes 52, 72.

It should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. It should be noted, however, that while the gravel packing apparatus of the present invention will likely have the described vertical orientation when assembled on the rig floor, once downhole, the gravel packing apparatus of the present invention is not limited to such orientation as it is equally-well suited for use in inclined and horizontal orientations.

As illustrated in FIG. 3, gravel packing apparatus 50 includes a plurality of sensors that are operably associated with instrument wire 90. Specifically, gravel packing apparatus 50 includes sensors 104, 106, 108, 110. Sensor 104 is shown as positioned on the outer surface of base pipe 52. Sensor 106 is shown attached to the inner surface of screen wire 58. Sensor 108 is shown as positioned on the inner surface of base pipe 52. Sensor 110 is shown attached to the outer surface of screen wire 58. Alternatively, a sensor could be coupled to a rod 56. Sensors 104, 106, 108, 110 may be selected from a group including pressure sensors, temperature sensors, piezoelectric acoustic sensors, flow meters for determining flow rate, accelerometers, resistivity sensors for determining water content, velocity sensors or any other sensor that measures a fluid property or physical parameter downhole. As used herein, the term sensor shall include any of these sensors as well as any others that are used in downhole environments and the equivalents to these sensors.

Figure 4:
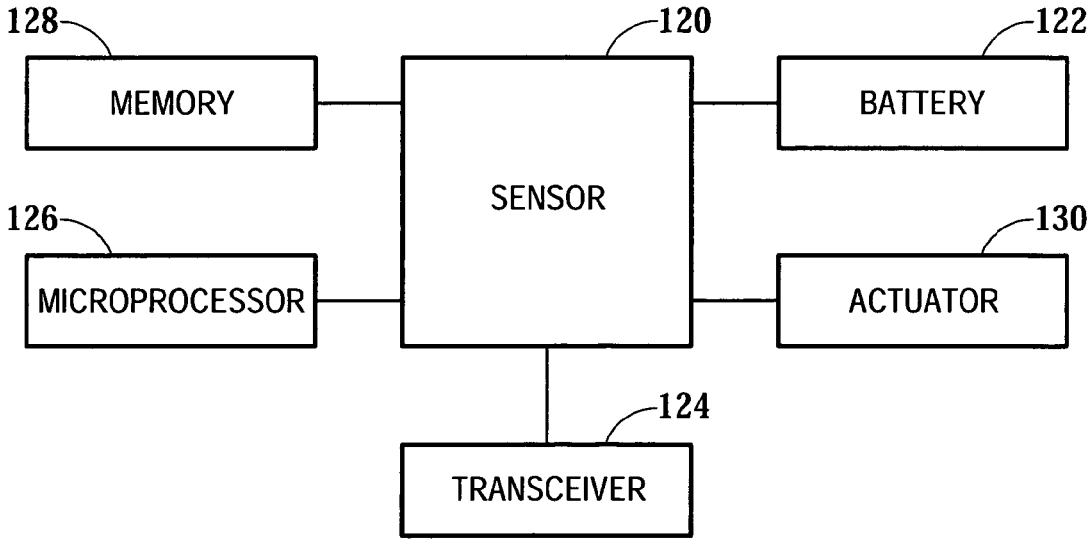
FIG. 4 is a block diagram of a sensor for use in a gravel packing apparatus having integrated sensors of the present invention.

As illustrated in FIG. 4, a sensor 120 can be powered by a battery 122. Alternatively, power may be provided to sensor 120 from the surface via an instrument line. In the illustrated embodiment, sensor 120 is coupled to transceiver 124 that is used to transmit data and receive instructions between sensor 120 and the surface or between sensor 120 and another downhole system. Transceiver 124 could be powered by battery 122. Sensor 120 has a microprocessor 126 associated therewith to allow for manipulation and interpretation of the sensor data and for processing the received instructions. Likewise, sensor 120 is coupled to a memory 128 which provides for storing information for later batch processing or batch transmission. Importantly, this combination of components provides for localized control and operation of an actuator 130 which may be a flow control device, such as a sliding sleeve, associated with gravel packing apparatus 50 to selectively permit and prevent fluid flow therethrough or which may be a safety device or other actuatable downhole device.

Figure 5:
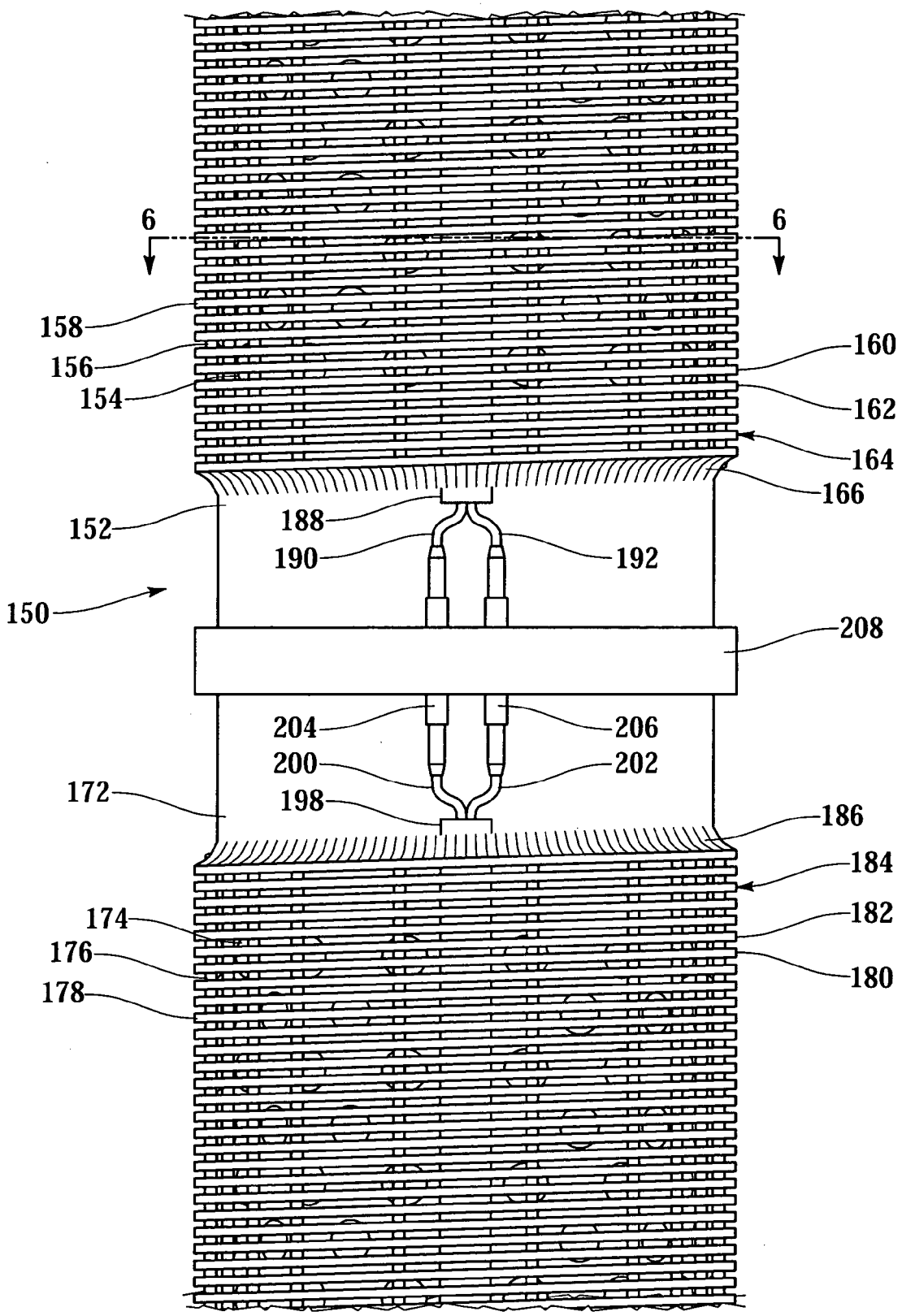
FIG. 5 is side view of a gravel packing apparatus having integrated sensors of the present invention.

Referring now to FIG. 5 therein is depicted an alternate embodiment illustrating two adjacent sections of a gravel packing apparatus having integrated sensors of the present invention that is generally designated 150. In the illustrated embodiment, gravel packing apparatus 150 includes an upper base pipe 152 that has a plurality of openings 154 which allow the flow of fluids therethrough. Spaced around base pipe 152 is a plurality of ribs 156 that are generally symmetrically distributed about the axis of base pipe 152. Wrapped around ribs 156 is a screen wire 158. Screen wire 158 forms a plurality of turns, such as turn 160 and turn 162. Between each of the turns is a gap through which fluids flow. Together, ribs 156 and screen wire 158 form a sand control screen jacket 164 which is attached to base pipe 152 at weld 166 or by other suitable technique.

Similarly, gravel packing apparatus 150 includes a lower base pipe 172 that has a plurality of openings 174 which allow the flow of fluids therethrough. Spaced around base pipe 172 is a plurality of ribs 176. Wrapped around ribs 176 is a screen wire 178 that forms a plurality of turns, such as turn 180 and turn 182. Between each of the turns is a gap through which fluids flow. Together, ribs 176 and screen wire 178 form a sand control screen jacket 184 which is attached to base pipe 172 at weld 186 or by other suitable technique.

Figure 6:
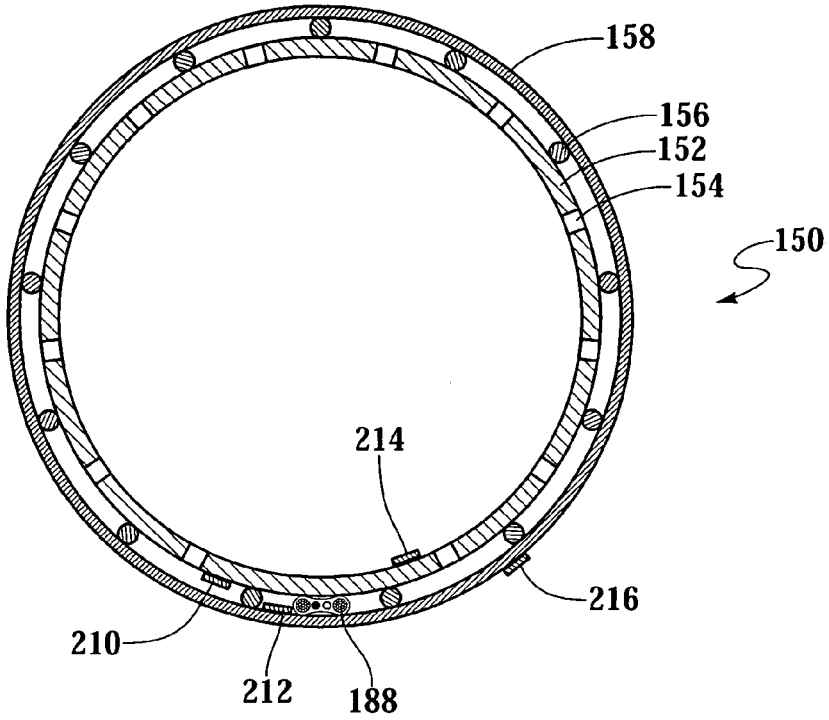
FIG. 6 is a cross sectional view taken along line 6—6 of FIG. 5 of a gravel packing apparatus having integrated sensors of the present invention.
Figure 7:
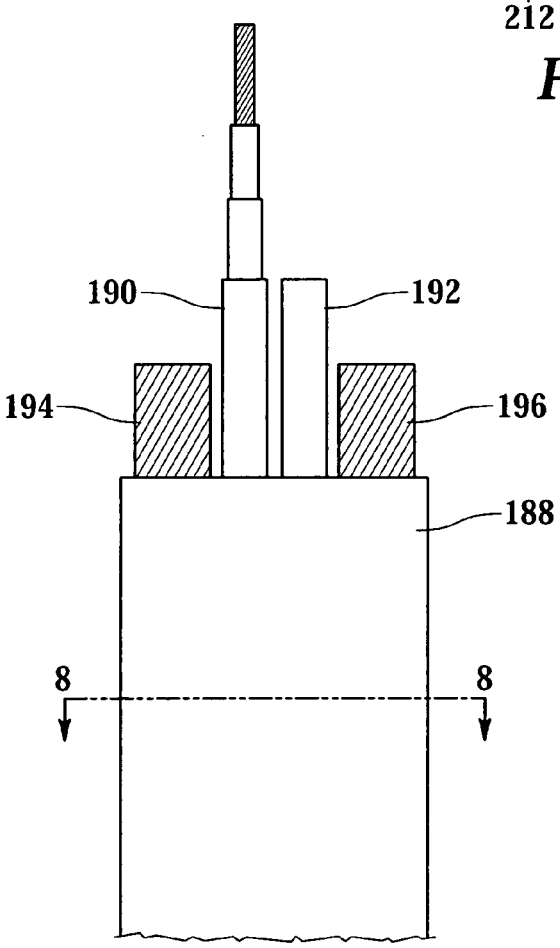
FIG. 7 is a side view of a flat pack wire bundle for use in a gravel packing apparatus having integrated sensors of the present invention.
Figure 8:
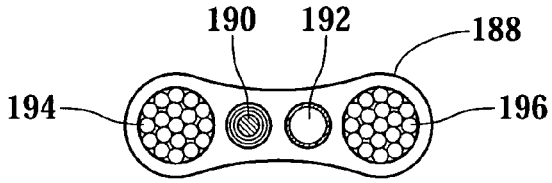
FIG. 8 is a cross sectional view taken along line 8—8 of FIG. 7 of a flat pack wire bundle for use in a gravel packing apparatus having integrated sensors of the present invention.

Base pipes 152, 172 are attached directly together via a box and pin type threaded coupling which preferably has timed threads to circumferentially orient base pipe 152 relative to base pipe 172. In the illustrated embodiment, a flat pack umbilical line passes through gravel packing apparatus 150. Specifically, an umbilical line 188 is positioned between base pipe 152 and screen wire 158 and passes through weld 166. As best seen in FIG. 6, umbilical line 188 is located adjacent to a portion of base pipe 152 without openings 154. Umbilical line 188 includes an instrument line 190, such as a copper wire, a coaxial cable, a fiber optic bundle, a twisted pair or other line suitable for transmitting power, signals, data and the like, and a hydraulic line 192. In addition, as best seen in FIGS. 7 and 8, umbilical line 188 includes a pair of bumper bars 194, 196, such as braided wire, which provides added rigidity to umbilical line 188. Likewise, an umbilical line 198 is positioned between base pipe 172 and screen wire 178, passes through weld 186 and is located adjacent to a portion of base pipe 172 without openings 174. Umbilical line 198 includes an instrument line 200 and a hydraulic line 202.

When base pipes 152, 172 are coupled together, instrument line 190 and hydraulic line 192 are substantially circumferentially aligned with instrument line 200 and hydraulic line 202 to allow for the coupling of instrument line 190 with instrument line 200 via high pressure instrument wire connector 204, as explained in greater detail below and hydraulic line 192 with hydraulic line 202 via high pressure hydraulic line connector 206, also as explained in greater detail below. Once the connections are made between instrument lines 190, 200 and hydraulic lines 192, 202, a support 208 such as a band, a collar, a block or other suitable device is used to maintain connectors 204, 206 in position adjacent to base pipes 152, 172.

As illustrated in FIG. 6, gravel packing apparatus 150 includes a plurality of sensors that are operably associated with umbilical line 188. Specifically, gravel packing apparatus 150 includes sensors 210, 212, 214, 216. Sensor 210 is shown as positioned on the outer surface of base pipe 152. Sensor 212 is shown attached to the inner surface of screen wire 158. Sensor 214 is shown as positioned on the inner surface of base pipe 152. Sensor 216 is shown attached to the outer surface of screen wire 158. Alternatively, a sensor could be coupled to a rod 156.

Figure 9:
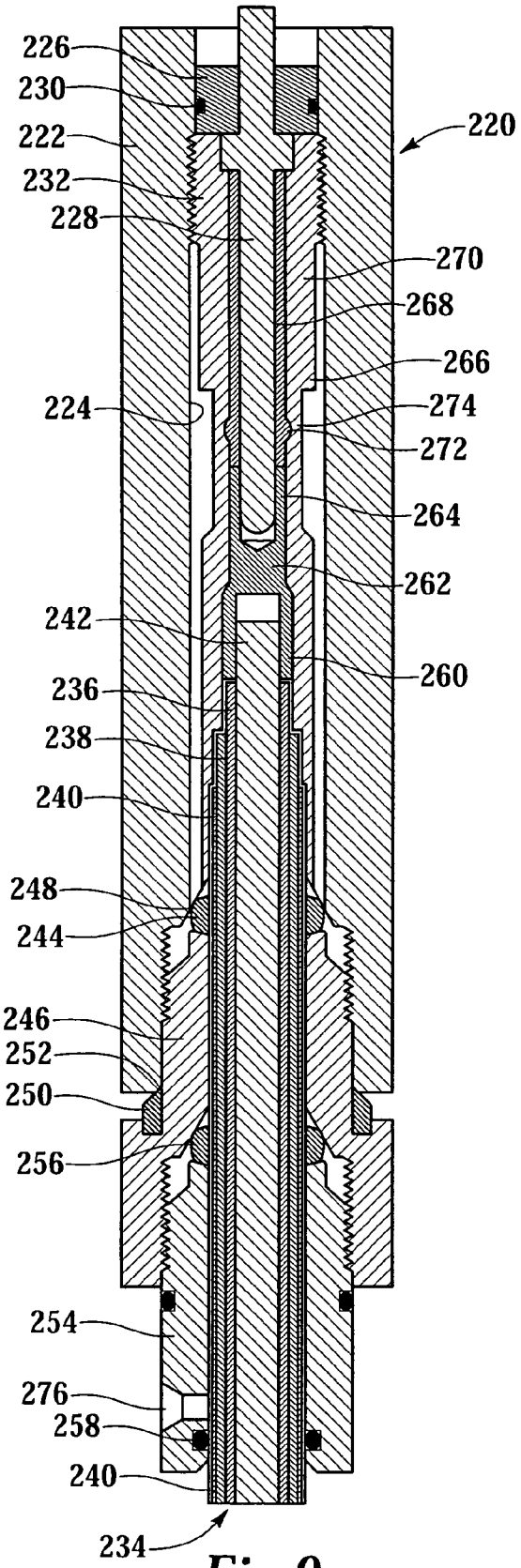
FIG. 9 is a cross sectional view of a high pressure instrument wire connector for use in a gravel packing apparatus having integrated sensors of the present invention.

Referring now to FIG. 9, therein is depicted a high pressure instrument wire connector that is general designated 220. Instrument wire connector 220 may be used to couple two sections of instrument wire together such as instrument lines 90, 94 of FIG. 2 or instrument lines 190, 200 of FIG. 5. It should be noted that FIG. 9 depicts only one end of connector 220 coupled to a single instrument line. The other instrument line is coupled to the opposite end (not pictured) of connector 220 which is substantially identical to the depicted end, thereby creating an electrical connection between the two adjacent instrument lines.

Connector 220 includes a housing 222 having a recess 224 which forms a hollow space within housing 222. A bulkhead 226 retains electrical conductor 228. Conductor 228 may be an instrument wire or wires suitable for use within a downhole well tool. A seal 230 prevents fluids from migrating past bulkhead 226. A retainer ring 232 is threadably engaged with housing 222 to retain bulkhead 226 in a fixed position.

Instrument line 234 is illustrated as a metal jacketed cable comprising insulation layer 236, insulation layer 238, metal sheath or jacket 240 and conductor 242. A metal ferrule or seal 244 is positioned between jacket 240 and housing 222 and is contacted by primary retainer 246 which is threadably engaged with housing 222. Rotation of retainer 246 relative to housing 222 urges seal 244 against housing bevel 248, which forces seal 244 into contact with housing 222 and metal jacket 240 to form a fluid tight metal-to-metal seal. Additionally, such connection provides a strong mechanical connection between housing 222 and instrument line 234 and prevents relative movement in axial and rotational directions. A second metal ferrule or seal 250 is positioned between retainer 246 and housing 222 such that, rotation of retainer 246 relative to housing 222 urges seal 250 against housing bevel 252, which forces seal 250 into contact with housing 222 and retainer 246 to form a fluid tight metal-to-metal seal therebetween.

An end cap 254 in threaded engagement with primary retainer 246 contacts a metal ferrule or seal 256 to form a metal-to-metal seal connection between primary retainer 246 and jacket 240. In this configuration, seal 256 provides a secondary or backup sealing function to primary seal 244 and prevents well fluids from contacting primary seal 244. This engagement between end cap 254 and seal 256 also provides a second mechanical connection between primary retainer 234 and jacket 240. In addition, an o-ring seal 258 is provided between end cap 254 and jacket 240.

Jacket 240 is shorter than insulation 238, insulation 238 is shorter than insulation 236 and insulation 236 is shorter than conductor 242 leaving an end portion of conductor 242 exposed. This end portion of conductor 242 is attached to connector end section 260 of connector 262 and can be soldered, welded, crimped or otherwise rigidly fastened to connector end section 260. End section 264 of connector 262 is engaged in electrical contact with electrical conductor 228. The sliding engagement between end section 264 and electrical conductor 228 permits electrical contact with electrical conductor 228 and electrical conductor 242 while permitting relative movement between end section 264 and electrical conductor 228. When primary retainer 246 is tightened relative to housing 222 to engage primary seal 244 and jacket 240, the overall distance between electrical conductor 228 and electrical conductor 242 will be shorter, and such relative movement is accommodated by end section 264 and electrical conductor 228. Such design maintains an unbroken electrical path from electrical conductor 242 through connector 262 to electrical conductor 228.

In the illustrated embodiment, an insulator 266 can be positioned between connector 262 and the interior wall of recess 224 in housing 222 to prevent movement or electrical conduction therebetween. One end of insulator 266 can be stepped to match the profile formed by instrument wire 234. Insulator 266 may be a single piece or may include a pair of insulator section 268, 270. As illustrated, section 268 has dog 272 which engages detent 274 in section 270 to provide a snap fitted connection therebetween.

End cap 254 has an aperture 276 that allows for the selective pressure testing of seal 244 after the connections have been made up, but before end cap 254 is tightened to activate seal 256. Pressure is provided through aperture 276 in end cap 254 with a test apparatus (not pictured). After the pressure testing of seal 244 is completed, end cap 254 is tightened to activate seal 256 allowing the selective pressure testing of seal 256. After the pressure testing of seal 256 is complete, the test apparatus is removed and a cap ring and seal (not pictured) can be installed to seal aperture 276.

Figure 10:
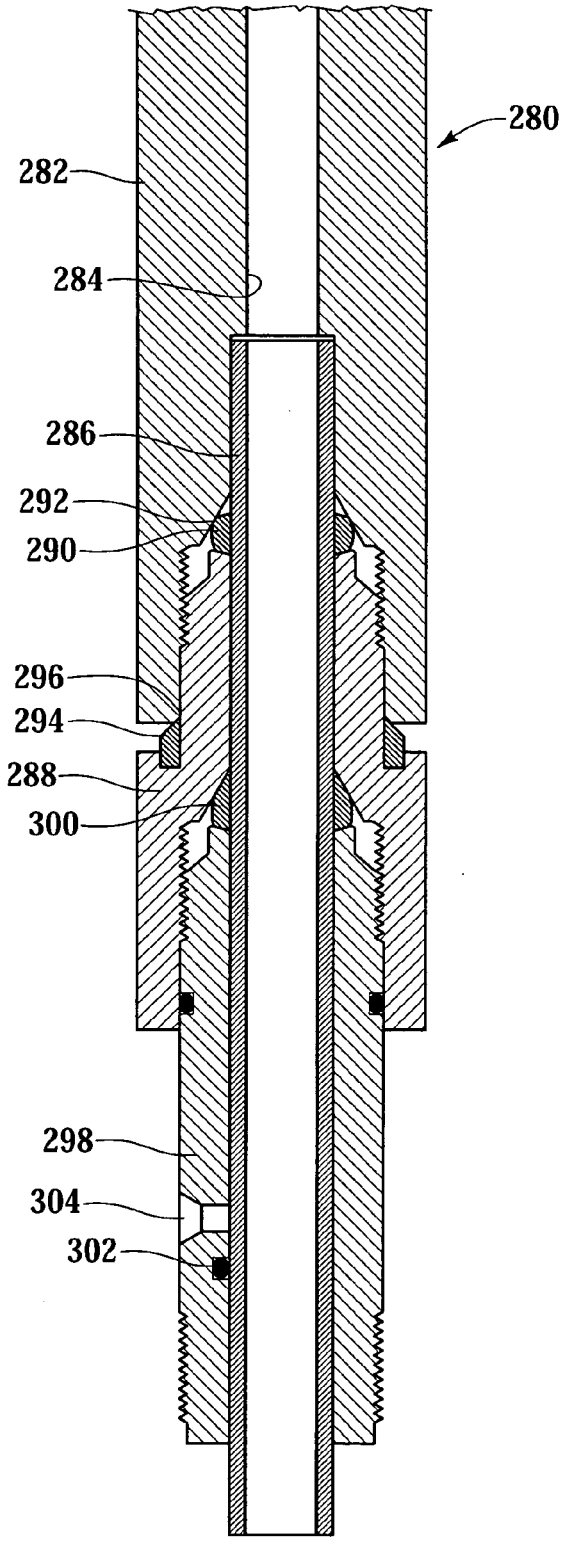
FIG. 10 is a cross sectional view of a high pressure hydraulic line connector for use in a gravel packing apparatus having integrated sensors of the present invention.

Referring now to FIG. 10, therein is depicted a high pressure hydraulic line connector that is general designated 280. Hydraulic line connector 280 may be used to couple two sections of hydraulic line together such as hydraulic lines 92, 96 of FIG. 2 or hydraulic lines 192, 202 of FIG. 5. It should be noted that FIG. 10 depicts only one end of connector 280 coupled to a single hydraulic line. The other hydraulic line is coupled to the opposite end (not pictured) of connector 280 which is substantially identical to the depicted end, thereby allowing fluid communication therebetween.

Connector 280 includes a housing 282 having a recess 284 which forms a hollow space within housing 282. A hydraulic conduit 286 is retained within housing 282. A retainer ring 288 is threadably engaged with housing 282 to maintain conduit 286 in a fixed position. A metal ferrule or seal 290 is positioned between conduit 286 and housing 282 and is contacted by primary retainer 288 which is threadably engaged with housing 282. Rotation of retainer 288 relative to housing 282 urges seal 290 against housing bevel 292, which forces seal 290 into contact with housing 282 and conduit 286 to form a fluid tight metal-to-metal seal. Additionally, such connection provides a strong mechanical connection between housing 282 and conduit 286 and prevents relative movement in axial and rotational directions. A second metal ferrule or seal 294 is positioned between retainer 288 and housing 282 such that, rotation of retainer 288 relative to housing 282 urges seal 294 against housing bevel 296, which forces seal 294 into contact with housing 282 and retainer 288 to form a fluid tight metal-to-metal seal therebetween.

An end cap 298 in threaded engagement with primary retainer 288 contacts a metal ferrule or seal 300 to form a metal-to-metal seal connection between primary retainer 288 and conduit 286. In this configuration, seal 300 provides a secondary or backup sealing function to primary seal 290 and prevents well fluids from contacting primary seal 290. This engagement between end cap 298 and seal 300 also provides a second mechanical connection between primary retainer 288 and conduit 286. In addition, an o-ring seal 302 is provided between end cap 298 and conduit 286.

End cap 298 has an aperture 304 that allows for the selective pressure testing of seal 290 after the connections have been made up, but before end cap 298 is tightened to activate seal 300. Pressure is provided through aperture 304 in end cap 298 with a test apparatus (not pictured). After the pressure testing of seal 290 is completed, end cap 298 is tightened to activate seal 300 allowing the selective pressure testing of seal 300. After the pressure testing of seal 300 is complete, the test apparatus is removed and a cap ring and seal (not pictured) can be installed to seal aperture 304.

Figure 11:
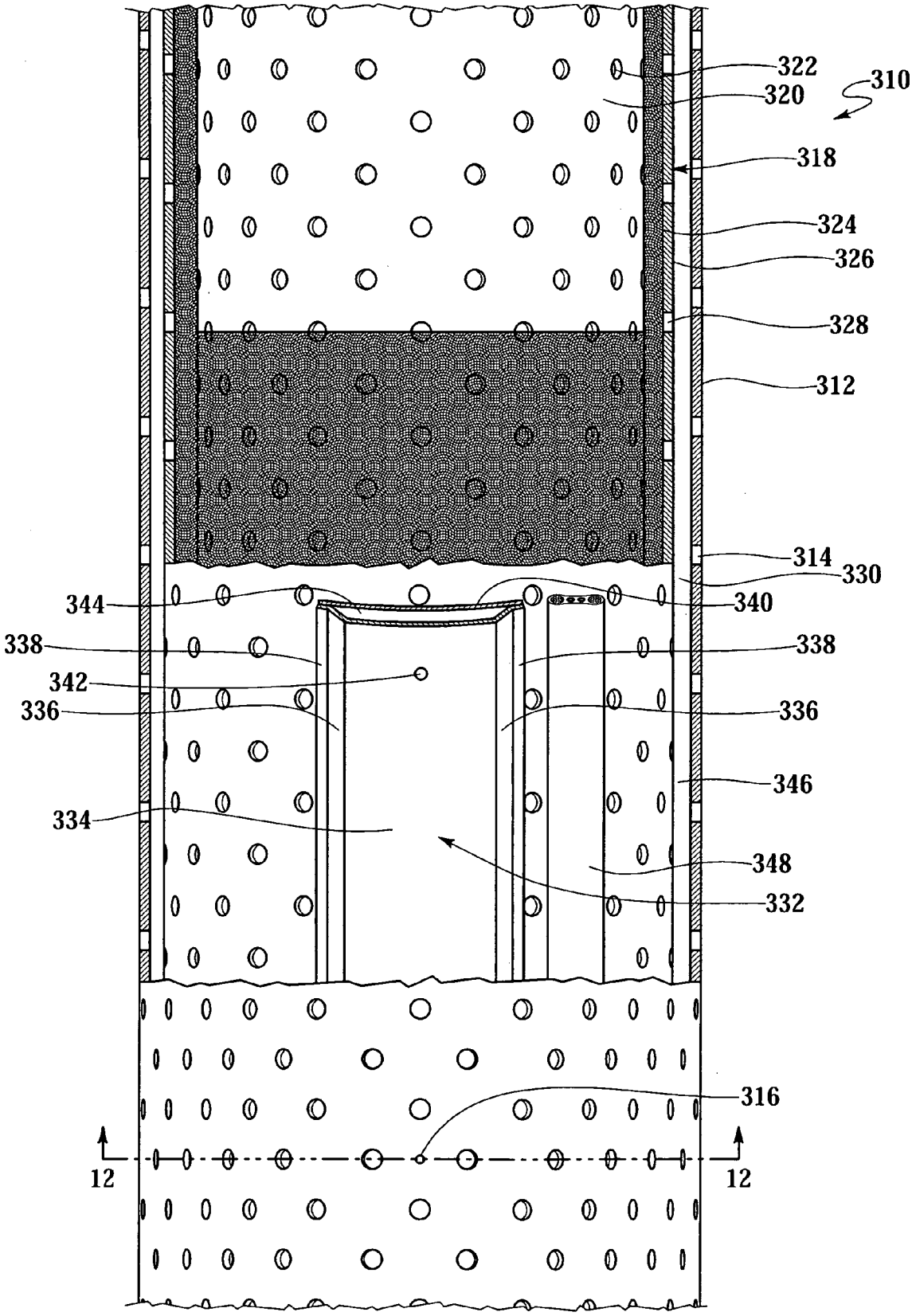
FIG. 11 is a side view, partially cut away, of a gravel packing apparatus having integrated sensors of the present invention.

Referring now to FIG. 11, therein is depicted a partial cut away view of a gravel packing apparatus having integrated sensors of the present invention that is generally designated 310. Apparatus 310 has an outer tubular 312 that includes a plurality of openings 314 that are substantially evenly distributed around and along the length of outer tubular 312, which allow the flow of production fluids therethrough. In addition, outer tubular 312 includes a plurality of outlets 316.

Disposed within outer tubular 312 is a sand control screen assembly 318. Sand control screen assembly 318 includes a base pipe 320 that has a plurality of openings 322 which allow the flow of production fluids into the production tubing. The exact number, size and shape of openings 322 are not critical to the present invention, so long as sufficient area is provided for fluid production and the integrity of base pipe 320 is maintained.

Positioned around base pipe 320 is a fluid-porous, particulate restricting wire mesh screen 324. Screen 324 is designed to allow fluid flow therethrough but prevent the flow of particulate materials of a predetermined size from passing therethrough. The layers of wire mesh may include drain layers that have a mesh size that is larger than the mesh size of the filter layers. For example, a drain layer may preferably be positioned as the outermost layer and the innermost layer of wire mesh screen 324 with the filter layer or layers positioned therebetween. Positioned around screen 324 is a screen wrapper 326 that has a plurality of openings 328 which allow the flow of production fluids therethrough. The exact number, size and shape of openings 328 is not critical to the present invention, so long as sufficient area is provided for fluid production and the integrity of screen wrapper 326 is maintained. Typically, various sections of screen 324 and screen wrapper 326 are manufactured together as a unit by, for example, diffusion bonding or sintering a number layers of wire mesh that form screen 324 together with screen wrapper 326, then rolling the unit into a tubular configuration. The two ends of the tubular unit are then seam welded together. Several tubular units of the screen and screen wrapper combination are placed over each joint of base pipe 320 and secured thereto by welding or other suitable technique.

Figure 12:
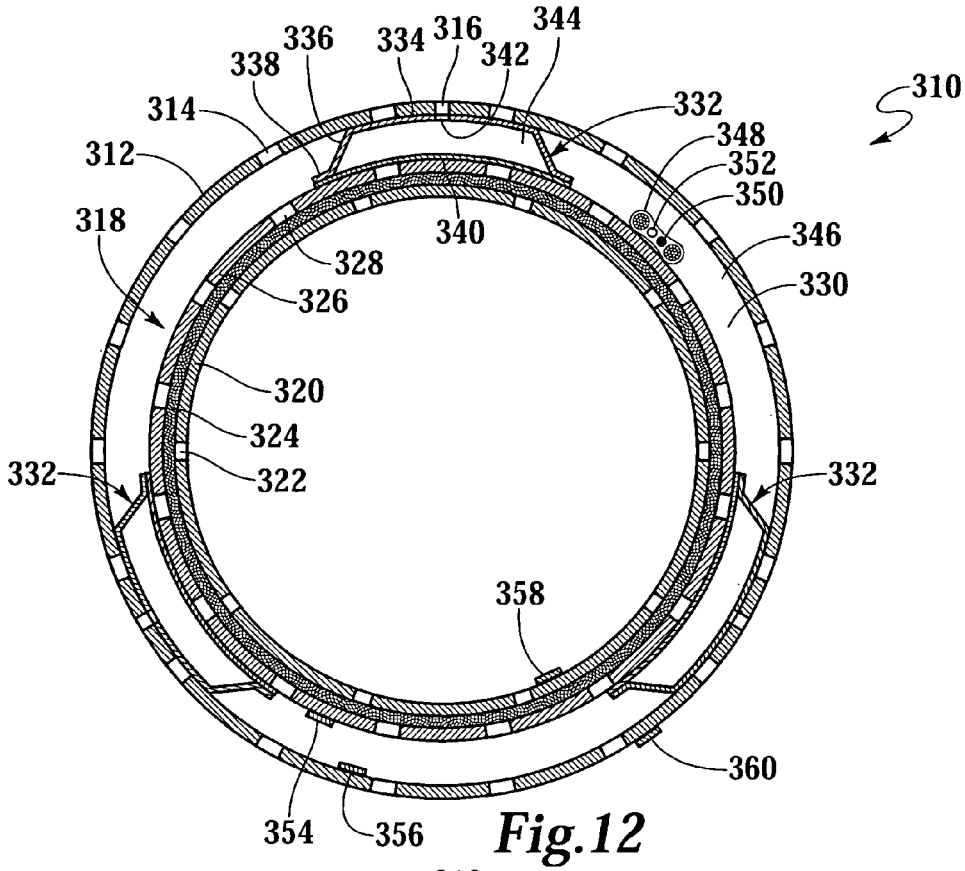
FIG. 12 is a cross sectional of a gravel packing apparatus having integrated sensors of the present invention.

Disposed in annulus 330 between outer tubular 312 and sand control screen 318 are three channels 332, as best seen in FIG. 12. Channels 332 include a web 334 and a pair of oppositely disposed sides 336 each having an end 338. Ends 338 are attached to a sheet member 340 and, in turn, to screen wrapper 326 by welding or other suitable technique. Channels 332 include a plurality of outlets 342 that are substantially aligned with outlets 316 of outer tubular 312 and are preferably formed at the same time by drilling or other suitable technique once gravel packing apparatus 310 is assembled. Together, channels 332 and sheet members 340 form slurry passageways 344.

It should be noted that in some embodiments, channels 332 could be attached directly to screen wrapper 326 if the adjacent portions of screen wrapper 326 are not perforated such that slurry passageways 344 may be formed. In either case, once screen 318 is assembled with channels 332 attached thereto, screen 318 is positioned within outer tubular 312. Once in this configuration, channels 332 are pressurized such that channels 332 expand into contact with the interior of outer tubular 312. Thereafter, outlets 342 of channels 332 and outlets 316 of outer tubular 312 may be drilled. Also, channels 332 define the circumferential boundary between slurry passageways 344 and production pathways 346.

In the illustrated embodiment, a flat pack umbilical line passes through gravel packing apparatus 310. Specifically, umbilical line 348 is positioned in a production pathway 346. Near the end of each joint of gravel packing apparatus 310, umbilical line 348 is routed to the exterior of gravel packing apparatus 310 for assembly. Umbilical line 348 is located adjacent to a portion of sand control screen 318 without openings 328. Umbilical line 348 includes an instrument line 350 and a hydraulic line 352. When each section of gravel packing apparatus 310 is coupled to the next, the respective umbilical lines 348 are substantially circumferentially aligned to allow for the coupling of respective instrument lines 350 via high pressure instrument wire connectors and respective hydraulic lines 352 via high pressure hydraulic line connectors as previously explained. Once the connections are made, a support such as a band, a collar, a block or other suitable device is used to maintain the connectors in position adjacent to gravel packing apparatus 350.

As illustrated in FIG. 12, gravel packing apparatus 310 includes a plurality of sensors. Specifically, gravel packing apparatus 310 includes sensors 354, 356, 358, 360. Sensor 354 is shown as positioned on the outer surface of sand control screen 318. Sensor 356 is shown attached to the inner surface of outer tubular 312. Sensor 358 is shown as positioned on the inner surface of sand control screen 318. Sensor 360 is shown attached to the outer surface of outer tubular 312.

Figure 13:
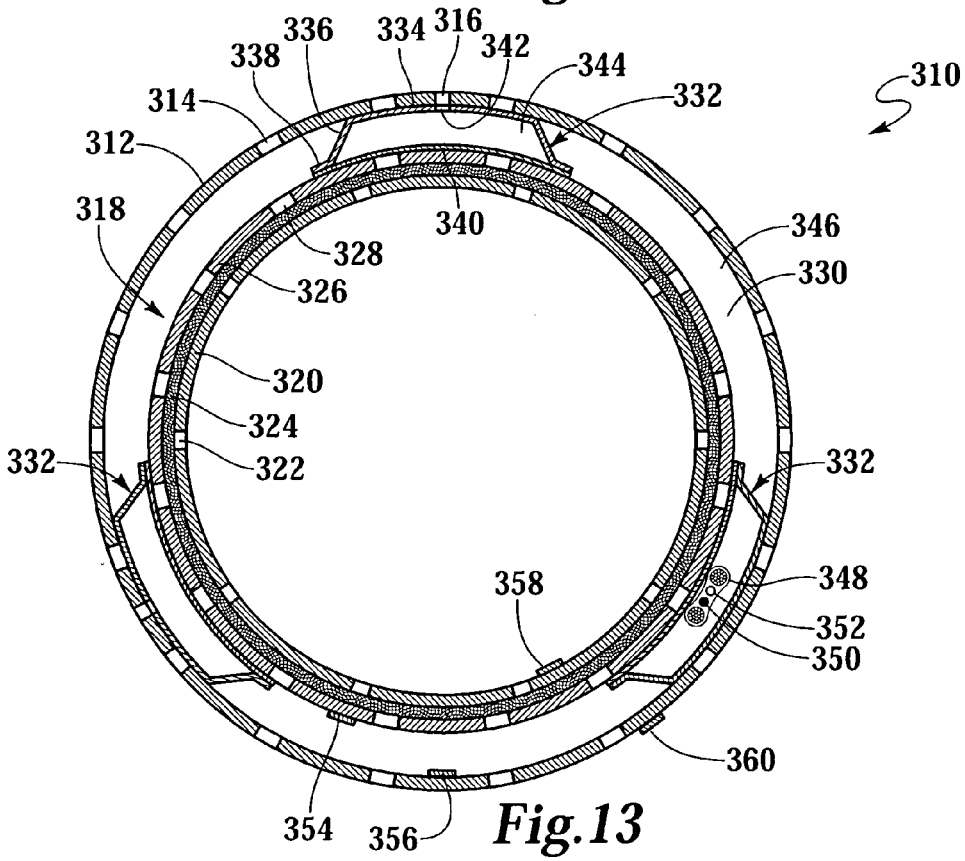
FIG. 13 is a cross sectional of a gravel packing apparatus having integrated sensors of the present invention.

As should be apparent to those skilled in the art, the gravel packing apparatus of the present invention may have a variety of configurations. For example, the gravel packing apparatus of the present invention includes configurations having other numbers of slurry passageways such as one, two, four or more slurry passageways and any number of umbilical lines passing therethrough. In addition and as illustrated in FIG. 13, the gravel packing apparatus of the present invention may have an umbilical line 348 positioned within one of the channels 332 instead within annulus 330. This configuration provides extra protection to umbilical line 348 during a treatment process and particularly during production as no fluids will be transported or produced through this channel 332.

Figure 14:
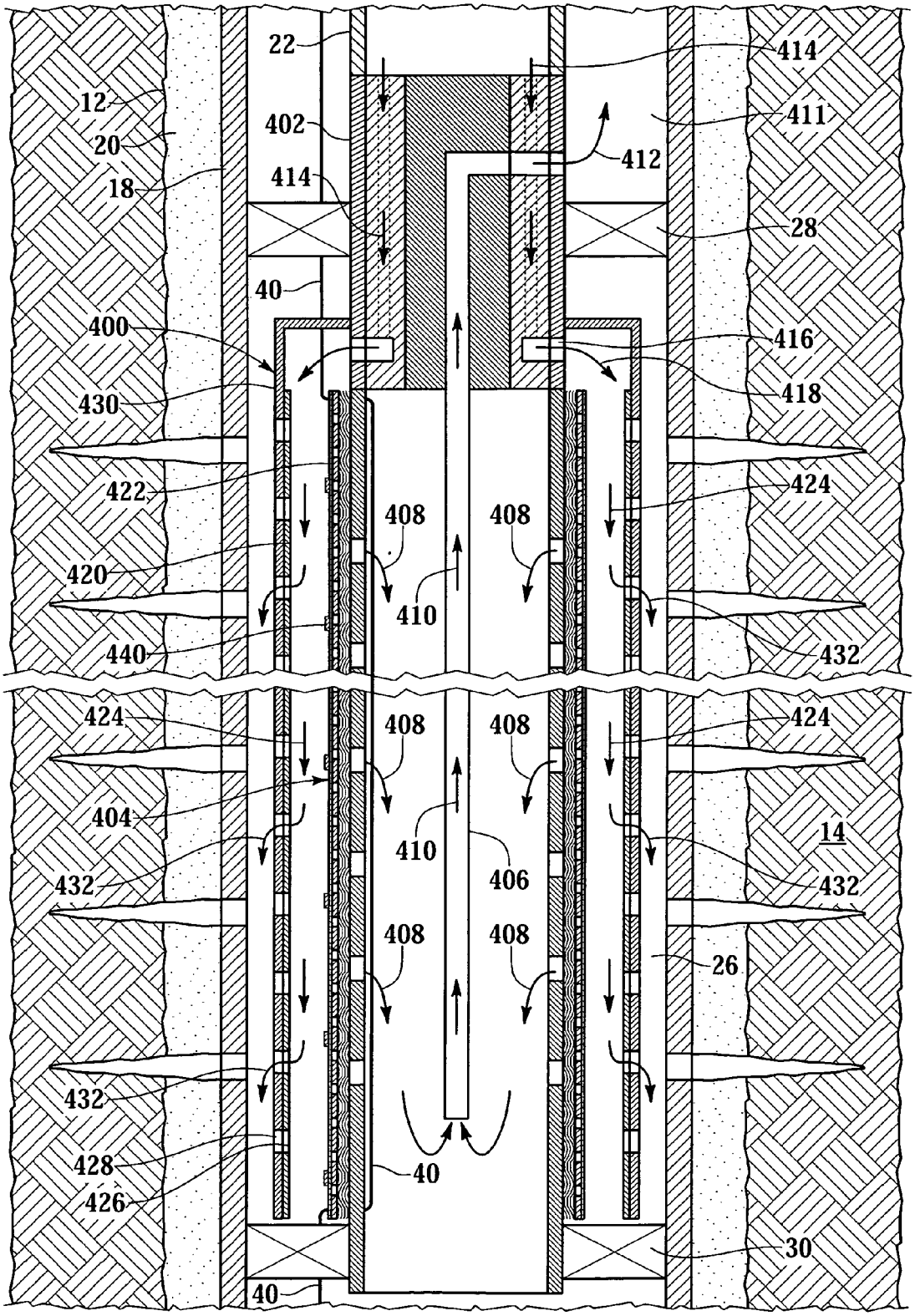
FIG. 14 is a cross sectional of a gravel packing apparatus having integrated sensors of the present invention positioned within a wellbore during a treatment operation.

Referring now to FIG. 14, a typical completion process using a gravel packing apparatus 400 having integrated sensors of the present invention will be described. First, interval 26 adjacent to formation 14 is isolated. Packer 28 seals the upper end of annular interval 26 and packer 30 seals the lower end of annular interval 26. Crossover assembly 402 is located adjacent to screen assembly 404, traversing packer 28 with portions of crossover assembly 402 on either side of packer 28. When the gravel packing operation commences, the objective is to uniformly and completely fill interval 26 with gravel. To help achieve this result, wash pipe 406 is disposed within screen assembly 404. Wash pipe 406 extends into crossover assembly 402 such that return fluid passing through screen assembly 404, indicated by arrows 408, may travel through wash pipe 406, as indicated by arrow 410, and into annulus 411, as indicted by arrow 412, for return to the surface.

The fluid slurry containing gravel is pumped down work string 22 into crossover assembly 402 along the path indicated by arrows 414. The fluid slurry containing gravel exits crossover assembly 402 through crossover ports 416 and is discharged into apparatus 400 as indicated by arrows 418. In the illustrated embodiment, the fluid slurry containing gravel then travels between channels 420 and sheet member 422 as indicated by arrows 424. At this point, portions of the fluid slurry containing gravel exit apparatus 400 through outlets 426 of channels 420 and outlets 428 of outer tubular 430, as indicated by arrows 432. As the fluid slurry containing gravel enters annular interval 26, the gravel drops out of the slurry and builds up from formation 14, filling the perforations and annular interval 26 around apparatus 400 forming the gravel pack. Some of the carrier fluid in the slurry may leak off through the perforations into formation 14 while the remainder of the carrier fluid passes through screen assembly 404, as indicated by arrows 408, that is sized to prevent gravel from flowing therethrough. The fluid flowing back through screen assembly 404, as explained above, follows the paths indicated by arrows 410, 412 back to the surface.

In operation, the gravel packing apparatus of the present invention is used to distribute the fluid slurry to various locations within the interval to be gravel packed by injecting the fluid slurry into the slurry passageways created by the channels and the sheet members of one or more joints of the apparatus. The fluid slurry exits through the various outlets along the slurry passageways and enters the annulus between the apparatus and the wellbore which may be cased or uncased. Once in this annulus, a portion of the gravel in the fluid slurry is deposited around the apparatus in the annulus such that the gravel migrates both circumferentially and axially from the outlets. This process progresses along the entire length of the apparatus such that the annular area becomes completely packed with the gravel. In addition, a portion of the fluid slurry enters the opening of the outer tubular which provides for the deposit of a portion of the gravel from the fluid slurry in the production pathways between the outer tubulars and the sand control screens. Again, this process progresses along the entire length of the apparatus such that each production pathway becomes completely packed with the gravel. Once both the annulus and the production pathways are completely packed with gravel, the gravel pack operation may cease.

Throughout the gravel placement process, sensors 440 that are operably associate with apparatus 400 and control line 40 are used to monitor the entire gravel packing operation and provide substantially real time data relating to the gravel placement. Sensors 400 are position in a variety of circumferential, axial and radial locations relative to apparatus 400. For example, sensors 400 may be located in the slurry passageways, in the production pathways, exterior of the outer tubular, interior of the sand control screen and along the entire length of apparatus 400. Having sensors 440 located in these positions enables the operator to obtain significant amounts of information relating to fluid velocity, conductivity, density and the like at a variety of location that can be indication of the progression and efficiency of a gravel packing operation. In this manner, the operator can adjust treatment fluid parameters to overcome any deficiencies in the gravel placement.

In some embodiments of the present invention, the fluid slurry may not initially be injected into the slurry passageways. Instead, the fluid slurry is injected directly into the annulus between the apparatus 400 and the wellbore. In such an embodiment, the primary path for the fluid slurry containing gravel as it is discharged from exit ports 316, is directly into annular interval 26. This is the primary path as the fluid slurry seeks the path of least resistance. Under ideal conditions, the fluid slurry travels throughout the entire interval 26 until interval 26 is completely packed with gravel. In addition, the fluid slurry enters the production pathways of apparatus 400 such that this area is also completely packed with gravel.

As stated above, however, sand bridges commonly form during the gravel packing of an interval when the fluid slurry is pumped directly into annular interval 26. These sand bridges are bypassed using the gravel packing apparatus of the present invention by first allowing the fluid slurry to pass through the outer tubular into the production pathways of apparatus 400, bypassing the sand bridge and then returning to annular interval 26 through the outer tubular to complete the gravel packing process. These pathways are considered the secondary path for the fluid slurry. If a sand bridge forms in the secondary paths prior to completing the gravel packing operation, then the fluid slurry enters channels 420 as described above. In this embodiment, channels 420 are considered the tertiary path for the fluid slurry. As the various paths for the fluid slurry are utilized, sensors 440 monitor and report these progressions such that the operator is informed in real time.

Once the gravel pack is completed and the well is brought on line, formation fluids that are produced into the gravel packed interval must travel through the gravel pack in the annulus, then enter the production pathways through the openings in the outer tubular where the formation fluids pass through the gravel pack between the outer tubular and the screen assembly. As such, the gravel packing apparatus of the present invention allows for a substantially complete gravel pack of an interval so that particulate materials in the formation fluid are filtered out. Sensors 440 continue to monitor fluid and other downhole parameters during production to provide valuable information to the operator.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A gravel packing apparatus comprising:

an outer tubular having a plurality of openings therethrough;

a sand control screen assembly disposed within the outer tubular, the sand control screen assembly preventing the flow of particulate material of a predetermined size therethrough but allowing the flow of production fluids therethrough; and a sensor disposed between the outer tubular and the sand control screen assembly and operably coupled to one of the outer tubular and the sand control screen assembly.

2. The apparatus as recited in claim 1 further comprising an instrument line disposed between the outer tubular and the sand control screen assembly, the instrument line operably associated with the sensor.

3. The apparatus as recited in claim 1 further comprising a slurry passageway disposed between the outer tubular and the sand control screen assembly.

4. The apparatus as recited in claim 3 further comprising an instrument line disposed within the slurry passageway,the instrument line operably associated with the sensor.

5. The apparatus as recited in claim 1 further comprising a production pathway disposed between the outer tubular and the sand control screen assembly.

6. The apparatus as recited in claim 5 further comprising an instrument line disposed within the production pathway, the instrument line operably associated with the sensor.

7. The apparatus as recited in claim 1 further comprising an umbilical line disposed between the outer tubular and the sand control screen assembly, the umbilical line including an instrument line operably associated with the sensor, a hydraulic line and a pair of bumper bars.

8. The apparatus as recited in claim 1 further comprising a downhole power source coupled to the sensor.

9. The apparatus as recited in claim 1 further comprising a surface power source coupled to the sensor.

10. The apparatus as recited in claim 1 wherein the sensor is selected from a group consisting of a pressure sensor, a temperature sensor, a density meter and an accelerometer.

11. The apparatus as recited in claim 1 wherein the sensor is coupled to a component selected from a group consisting of a memory, a microprocessor, a transceiver and an actuator.

12. A gravel packing apparatus comprising:

first and second joints each having substantially the same construction and each having a perforated outer tubular, a sand control screen assembly disposed within the outer tubular, a sensor disposed between the outer tubular and the sand control screen assembly and operably coupled to one of the outer tubular and the sand control screen assembly and an instrument line disposed between the outer tubular and the sand control screen assembly, the instrument line having ends that extend exteriorly of the outer tubular, the instrument line operably associated with the sensor;

a coupling that couples the first and second joints together; and an instrument line connector that connects respective ends of the instrument line from the first and second joints together.

13. The apparatus as recited in claim 12 wherein each joint further comprises a slurry passageway disposed between the outer tubular and the sand control screen assembly.

14. The apparatus as recited in claim 13 wherein the instrument line is disposed within the slurry passageway.

15. The apparatus as recited in claim 12 wherein each joint further comprises a production pathway disposed between the outer tubular and the sand control screen assembly.

16. The apparatus as recited in claim 15 wherein the instrument line is disposed with the production pathway.

17. The apparatus as recited in claim 12 wherein the instrument line is disposed within an umbilical line that includes a hydraulic line and a pair of bumper bars.

18. The apparatus as recited in claim 12 further comprising a downhole power source coupled to each of the sensors.

19. The apparatus as recited in claim 12 further comprising a surface power source coupled to each of the sensors.

20. The apparatus as recited in claim 12 wherein the sensors are selected from a group consisting of pressure sensors, temperature sensors, density meters and accelerometers.

21. The apparatus as recited in claim 12 wherein the sensors are coupled to components selected from a group consisting of memory, microprocessors, transceivers and actuators.

22. The apparatus as recited in claim 12 wherein the coupling further comprises a threaded coupling.

23. The apparatus as recited in claim 12 wherein the coupling further comprises a threaded coupling having timed threads.

24. The apparatus as recited in claim 12 wherein the coupling further comprises a ratch latch.

25. The apparatus as recited in claim 12 wherein the coupling further comprises a collar.

26. The apparatus as recited in claim 12 wherein the instrument line connector further comprises a high pressure instrument line connector.

27. A gravel packing apparatus comprising:

first and second joints each having substantially the same construction and each having a sand control screen assembly having a perforated base pipe and a filter medium, a sensor disposed between the base pipe and the filter medium and operably coupled to one of the base pipe and the filter medium and an instrument line disposed between the base pipe and the filter medium, the instrument line having ends that extend exteriorly of the base pipe and the filter medium, the instrument line operably associated with the sensor;

a coupling that couples the first and second joints together; and an instrument line connector that connects respective ends of the instrument line from the first and second joints together.

28. The apparatus as recited in claim 27 wherein the instrument line is disposed within an umbilical line that includes a hydraulic Line and a pair of bumper bars.

29. The apparatus as recited in claim 27 further comprising a downhole power source coupled to each of the sensors.

30. The apparatus as recited in claim 27 further comprising a surface power source coupled to each of the sensors.

31. The apparatus as recited in claim 27 wherein the sensors are selected from a group consisting of pressure sensors, temperature sensors, density meters and accelerometers.

32. The apparatus as recited in claim 27 wherein the sensors are coupled to components selected from a group consisting of memory, microprocessors, transceivers and actuators.

33. The apparatus as recited in claim 27 wherein the coupling further comprises a threaded coupling.

34. The apparatus as recited in claim 27 wherein the coupling further comprises a threaded coupling having timed threads.

35. The apparatus as recited in claim 27 wherein the coupling further comprises a ratch latch.

36. The apparatus as recited in claim 27 wherein the coupling further comprises a collar.

37. The apparatus as recited in claim 27 wherein the instrument line connector further comprises a high pressure instrument line connector.

38. A method for treating an interval of a wellbore, the method comprising the steps of:

locating a gravel packing apparatus having an outer tubular positioned around a sand control screen assembly within the interval of the wellbore forming a wellbore annulus;

injecting a treatment fluid into the wellbore annulus; and monitoring the treatment process with a sensor disposed between the outer tubular and the sand control screen assembly and operably coupled to one of the outer tubular and the sand control screen assembly.

39. The method as recited in claim 38 further comprising disposing an instrument line between the outer tubular and the sand control screen assembly and operably associating the instrument line with the sensor.

40. The method as recited in claim 39 further comprising disposing the instrument line within a slurry passageway disposed between the outer tubular and the sand control screen assembly.

41. The method as recited in claim 39 further comprising disposing the instrument line within a production pathway disposed between the outer tubular and the sand control screen assembly.

42. The method as recited in claim 38 further comprising disposing an umbilical line between the outer tubular and the sand control screen assembly, the umbilical line including an instrument line operably associated with the sensor, a hydraulic line and a pair of bumper bars.

43. The method as recited in claim 38 further comprising powering the sensor with a downhole power source.

44. The method as recited in claim 38 further comprising powering the sensor with a surface power source.

45. The method as recited in claim 38 further comprising selecting the sensor from a group consisting of a pressure sensor, a temperature sensor, a density meter and an accelerometer.

46. The method as recited in claim 38 further comprising coupling the sensor to a component selected from a group consisting of a memory, a microprocessor, a transceiver and an actuator.

47. A method for treating an interval of a wellbore, the method comprising the steps of:

coupling first and second joints of a gravel packing apparatus together, each joint having a perforated tubular, a filter medium, a sensor disposed between the perforated tabular and the filter medium that is operably coupled to one of the perforated tabular and the filter medium and an instrument line disposed between the perforated tabular and the filter medium, the instrument line having ends that extend outwardly therefrom;

connecting the ends of the instrument lines from respective joints of the gravel packing apparatus;

locating the first and second joints within the interval of the wellbore forming a wellbore annulus;

injecting a treatment fluid into the wellbore annulus; and monitoring the treatment process with the sensors.

48. The method as recited in claim 47 further comprising disposing the instrument line between an outer tubular and a sand control assembly of each joint.

49. The method as recited in claim 48 further comprising disposing the instrument line within a slurry passageway of each joint.

50. The method as recited in claim 48 further comprising disposing the instrument line within a production pathway of each joint.

51. The method as recited in claim 47 further comprising disposing the instrument line between a base pipe and the filter medium of each joint.

52. The method as recited in claim 47 further comprising disposing the instrument line within an umbilical line that includes a hydraulic line and a pair of bumper bars.

53. The method as recited in claim 47 further comprising powering the sensors with a downhole power source.

54. The method as recited in claim 47 further comprising powering the sensors with a surface power source.

55. The method as recited in claim 47 further comprising selecting the sensors from a group consisting of a pressure sensor, a temperature sensor, a density meter and an accelerometer.

56. The method as recited in claim 47 further comprising coupling each of the sensors to a component selected from a group consisting of a memory, a microprocessor, a transceiver and an actuator.

* * * * *